US005564661A

United States Patent [19]

Gershon

[11] Patent Number: 5,564,661

[45] Date of Patent: Oct. 15, 1996

[54] LECTERN OR STAND PRIMARILY FOR MUSICIANS

[76] Inventor: Monty B. Gershon, 23 Raleigh Close, London NW4 2SX, Great Britain

[21] Appl. No.: 225,961

[22] PCT Filed: Apr. 8, 1994

[86] PCT No.: PCT/GB92/01851

§ 371 Date: Apr. 8, 1994

§ 102(e) Date: Apr. 8, 1994

[87] PCT Pub. No.: WO93/06762

PCT Pub. Date: Apr. 15, 1993

[51] Int. Cl.[6] ..... F16M 11/38

[52] U.S. Cl. ..... 248/167; 248/188.6

[58] Field of Search ..... 248/170, 166, 248/167, 177, 173, 178, 188.6, 441.1, 447, 454, 460, 463, 464, 465, 186, 185

[56] References Cited

U.S. PATENT DOCUMENTS

| | | | |
|---|---|---|---|
| 1,232,564 | 7/1917 | Karges | 248/185 |
| 2,090,000 | 8/1937 | Hager et al. . | |
| 2,799,968 | 7/1957 | Wythe | 248/454 |
| 4,606,525 | 8/1986 | Lombardi | 248/460 |
| 4,813,644 | 3/1989 | Goldner | 248/441.1 |
| 4,819,902 | 4/1989 | Wenger et al. | 248/460 |
| 5,106,048 | 4/1992 | Lebar et al. | 248/167 X |
| 5,267,712 | 12/1993 | Shen | 248/185 X |

FOREIGN PATENT DOCUMENTS

| | | | |
|---|---|---|---|
| 596125 | 10/1925 | France | 248/185 |
| 3311908A1 | 10/1984 | Germany . | |
| 2086219 | 5/1982 | United Kingdom . | |
| 2244424 | 12/1991 | United Kingdom . | |

*Primary Examiner*—Ramon O. Ramirez
*Attorney, Agent, or Firm*—Richard C. Litman

[57] ABSTRACT

A music stand is constructed from a tripodal base unit having three legs which are pivotally coupled to a base coupling. Slidably located within the base coupling is a telescopic column assembly consisting of a lower telescoping member, a middle telescoping member and an upper telescoping member. Each telescoping member has a keyway cut into the internal profile to prevent rotation and so increase stability. With each member there is associated a rotatable locking element by which one member may be frictionally engaged with the next telescoping member. The lowermost telescoping member may slide down through the base coupling following which the legs may be folded inwardly to lie around said member.

5 Claims, 4 Drawing Sheets

LECTERN OR STAND PRIMARILY FOR MUSICIANS

This invention relates to a lectern or stand which is primarily intended for use by musicians providing a support for receiving sheet music or full score. The prior art is exemplified by one known construction of fully folding music stand comprising a tripodal base carrying a vertical column on which is mounted a support for music formed from a number of pivotally interconnected slats which allow the support to be folded for storage or carriage. This known construction is relatively flimsy and in particular is easily knocked over. In addition, the structure is not substantial enough to be of use to conductors who require a stand or lectern of a more stable nature. In addition, the known construction is quite difficult to erect and collapse and can catch the user's fingers. Moreover, it is fixed in position by thumb screws in threaded metal holes which wear out and there is no special arrangement for carrying it.

One of the objects of this invention is to provide a lectern or stand which has improved stability and which may be collapsed into neat component parts to fit into a music case, and in particular into a specifically designed carrying case.

Broadly, and in accordance with one aspect of this invention, there is provided a stand for supporting music or the like comprising a tripodal base member including three legs each pivotally connected connected at their one ends to a base couple, a vertical support column with a lower section slidably embraced by the base coupling, each leg having a strut pivotably connected at one end to an intermediate point on the leg and at the other end to a lower part of the lower section of the vertical support column, whereby the legs may be swung from a first stored position in which they lie in parallel juxtaposed relationship when the base coupling is remote from the lower part of the vertical support to an extended in use position to form a tripod structure when the base coupling is moved adjacent said lower part, the column comprising a plurality of telescopically slidable sections with the topmost section including a connector for element with a support, the connector permitting relative angular adjustment between the support and telescopic column.

Although the construction described and claimed herein refers to a tripod base member it is to be understood that four, or more, legs could be provided without departing from the essence of this invention.

Preferably the lower telescopic section is slidable within the base coupling and tie legs are capable of inward pivoting so as to lie parallel and circumferentially around the said lowermost telescopic member.

An advantage of adopting a construction of this nature is that when the three ground support legs are folded inwardly to lie in parallel relationship, the cross section between said legs may accommodate the lowermost section of the telescopic support with the length of this section being comparable to the length of the legs. The further telescopic sections all nest within the lower section and thus the overall length of the stand may be significantly reduced to a dimension which enables same to be accommodated within a case specifically designed for holding sheet music as example.

The support for the music may comprise a rigid rectangular plate or board and includes a means permitting releasable coupling with the connector end of the uppermost telescopic section. The connector permits angular adjustment such that the facing plane of the support may be positioned at the most convenient angle for a user.

Further and preferred features of this invention will be described in conjunction with the accompanying drawings which show one constructional embodiment by way of an example.

Referring to the drawings.

Figure 1:
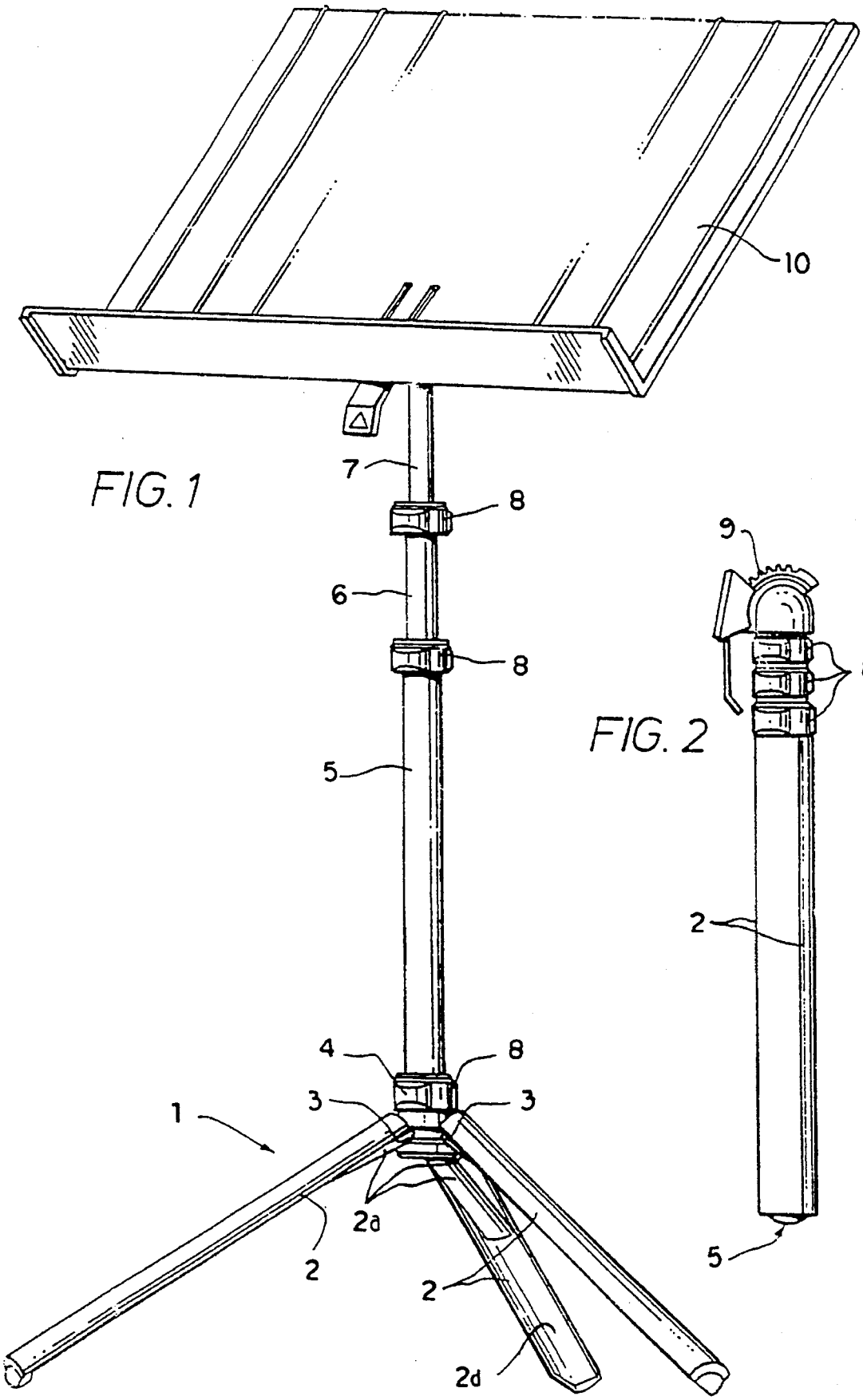
Figure 1 shows the music stand in an in use position.
Figure 2:
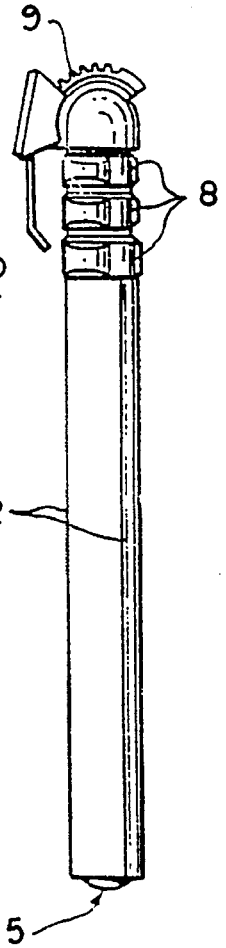
FIG. 2 shows the tripod support part in a collapsed position.

Referring firstly to FIGS. 1 and 2 of the drawings these show a general view of the music stand when erected and when collapsed. As shown, the stand is constructed from a tripodal base unit 1 having three legs 2 which are pivotally coupled at 3 to a base coupling 4. Slidably located within the base coupling 4 is a telescopic column assembly consisting of a lower telescoping member 5, a middle telescoping member 6 and an upper telescoping member 7. Each telescoping member has a keyway cut into the internal profile to prevent rotation and so increase stabibility. With each telescoping member 5 and 6 there is associated at the upper end a rotatable locking element 8 by which one member may be frictionally engaged with the next telescoping member. The lowermost telescoping member 5 may slide down through the base coupling 4 which also includes a locking member 8 following which the legs 2 may be folded inwardly to lie around said member 5 (FIG. 2) Legs 2 have a channel shaped cross-section **2*d* (FIGS. 1 and 4) which circumferentially embrace the lowermost telescopic section 5 and struts 2*a* when in the stored position of FIG. 2. With all the members 5, 6 and 7 telescoped together and the legs 2 closed, the structure adopts the compact configuration as illustrated in FIG. 2. The uppermost telescoping member 7 carries a connector means 9 at its top end and this is described in more detail later. The connector 9 couples with a music support beard 10 which is provided with a releasable dovetail coupling actuated by sliding connector 9 away from board 10**.

Figure 3:
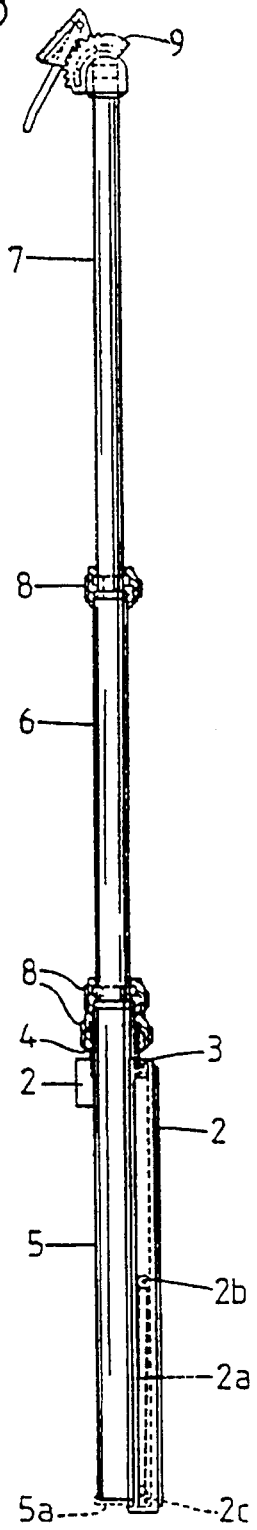
FIG. 3 shows the tripod support with the telescopic sections extended but with the legs collapsed.

Referring to FIG. 3 of the drawings, this shows the telescoping support fully extended but with the leg structure closed. As may be seen, each leg 2 is connected through pivot 3 with the base coupling 4 and includes a strut **2*a* which is pivotally connected with the leg 2 at 2*b* with the strut being further pivotally connected at 2*c* with an end cap 5*a* on the bottom of the lower telescopic member 5**.

Figure 4:
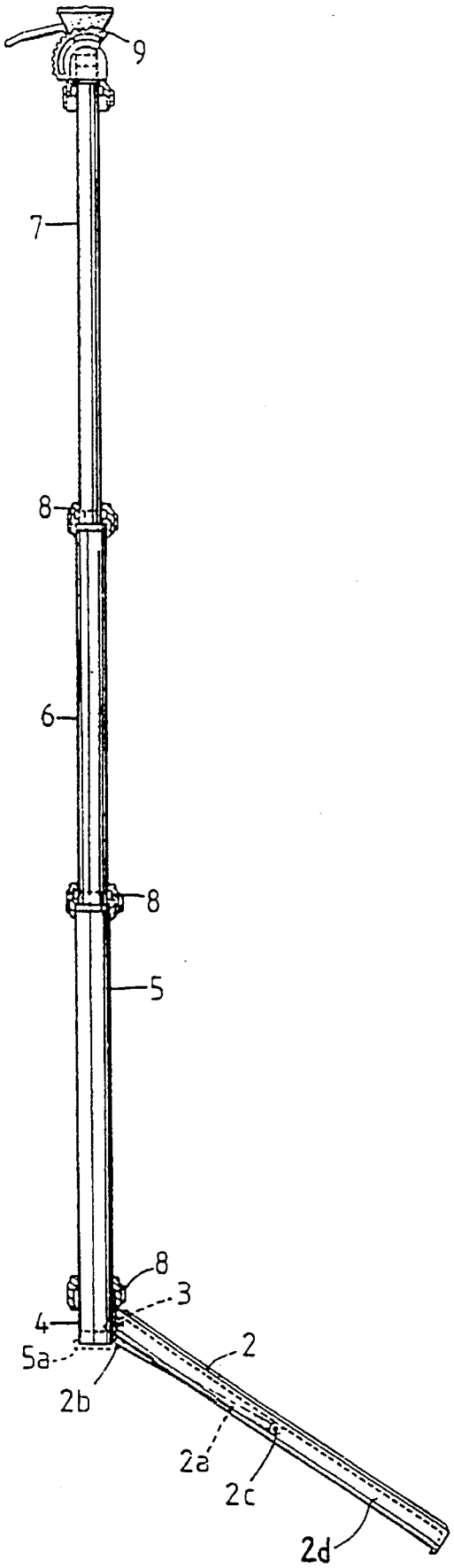
FIG. 4 is a view as in FIG. 3 but with the legs in the open in use position.

Referring now to FIG. 4, this shows the tripod legs in the extended position and as may be seen the base coupling 4 with associated lock 8 has down the lowermost telescopic member 5 into proximity with the end cap **5*a*. This action causes the leg 2 to swing outwards by virtue of the pivotal coupling of the strut 2*a*. When the lock 8** is tightened, the legs are firmly secured in their outwardly splayed position.

Figure 5:
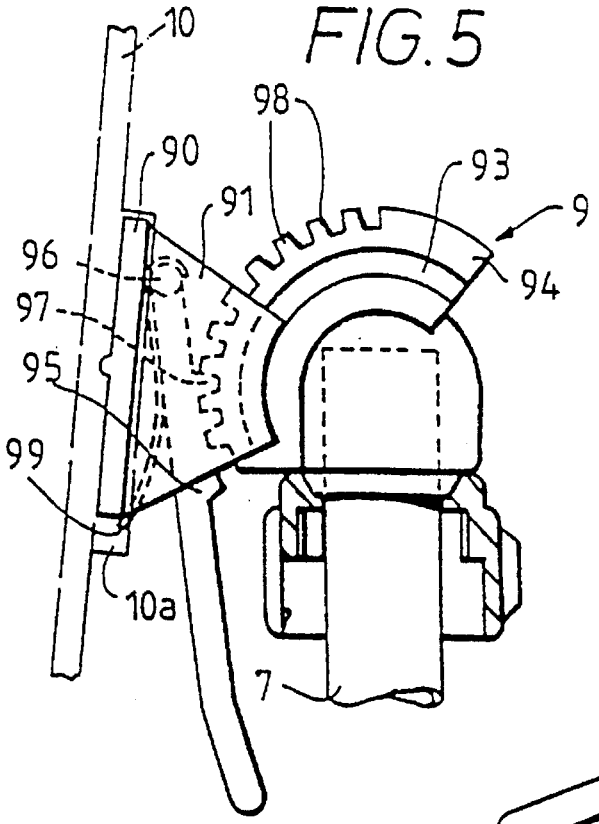
FIGS. 5 to 7 show details of the connector on the upper telescopic section.
Figure 6:
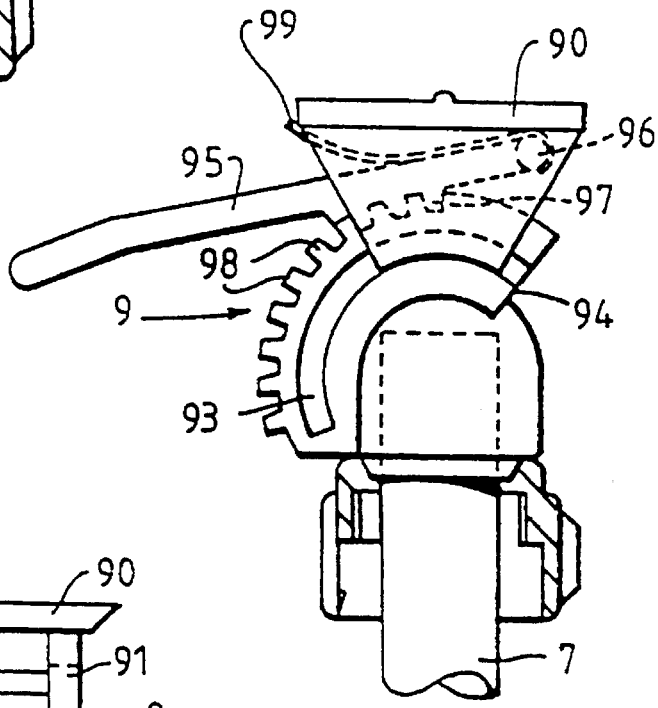
Figure 7:
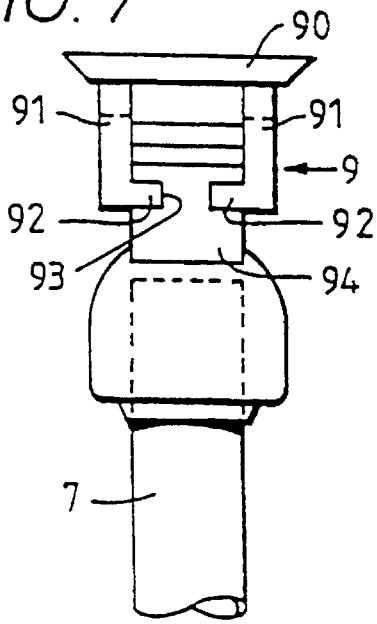

FIGS. 5 to 7 show in more detail the coupling head 9 which forms the means for connection with the music support board 10. The support board 10 includes a socket **10*a* on the rear which slidably engages plate 90 mounted on the connector 9. The socket 10*a* and plate 90 preferably have tapered or dove tail shape so that the support board 10** may fit with a wedging action for stability.

The plate member 90 has side limbs 91 with inwardly directed flanges 92 which engage an arcuate track 93 in a coupling head block 94. A spring loaded arm 95 is pivotally connected to the plate 90 at 96 and includes detent means 97 end, aging complementary detents 98 on the head 94. The lever 95 may be moved against the pressure of spring 99 whereby the detents 97, 98 are released enabling the plate member 90 to be moved arcuately along the track in the head 94. Thus the angular position of the face of the support 10 presented to a user may be conveniently adjusted and positively locked in a required position.

Figure 8:
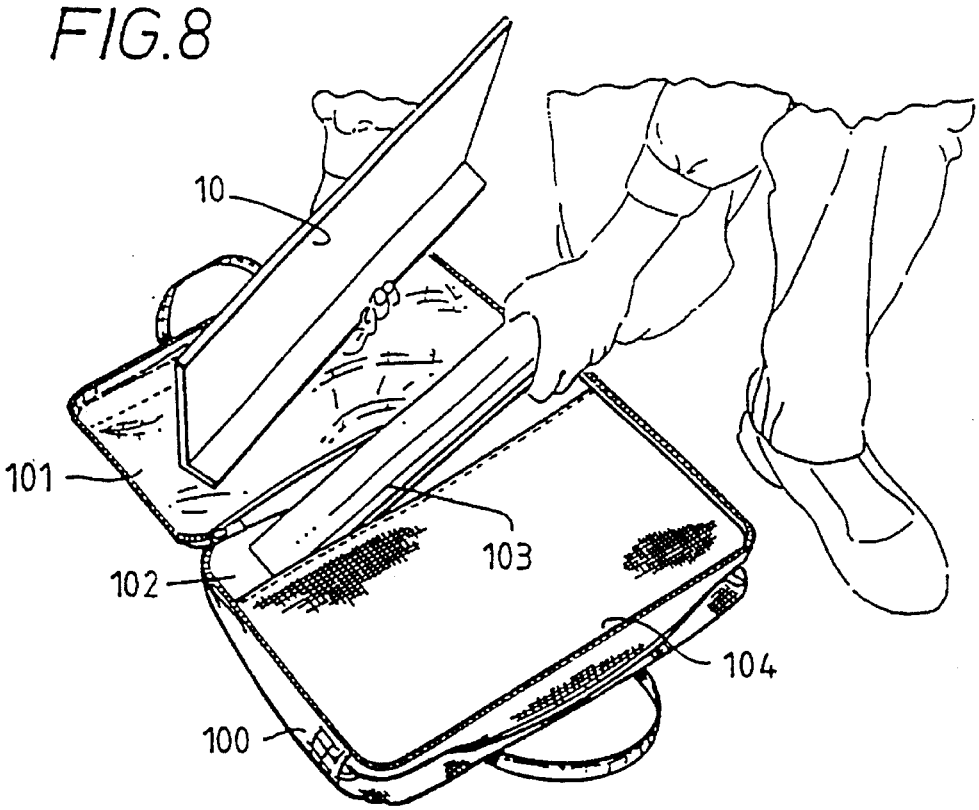
FIGS. 8 and 9 show a case for music in combination with the stand.
Figure 9:
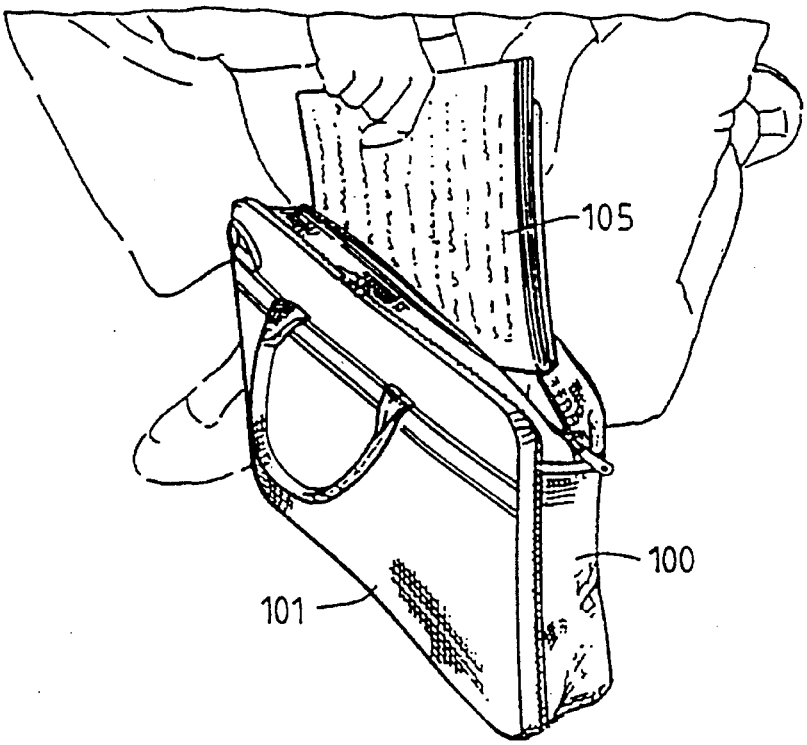

FIGS. 8 and 9 show a carrying case specifically designed for the previously described stand which will also accommodate sheet music, scores and other items. As shown in FIG. 8, the case 100 has a zippered lid which closes off compartment 102 serving to house the collapsed support stand 103 and providing a further area 104 in which the support 10 may be located. As shown in FIG. 9, a further zippered compartment is provided in the case 100 in which sheet music, scores and other items 105 may be accommodated.

The construction of support stand according to this invention may thus be collapsed into a compact unit which can be easily stored and carried in the accompanying case, along with sheet music books or even a musical instrument.

I claim:

1. A stand for supporting music comprising:

a vertical support column comprised of a plurality of telescopically slidable sections including an upper section having a connector with detachable interlocking engagement means for engaging a support, and a lower section having an end cap, said engagement means of said connector including an arcuate channelled member having a series of spaced detents, and a coupling slidable along said channelled member, said coupling having a catch member to releasably engage one of said detents to set the angular position of the support;

a base coupling slidably embracing said lower section of said vertical support column, said base coupling slidable from a deployed position immediately adjacent said end cap to a stored position remote from said end cap;

a tripodal base including three channel shaped legs, each of said legs having a first end pivotally connected to said base coupling, a second end, an intermediate point between the first end and the second end, and a strut having a first end pivotally connected to the intermediate point and a second end pivotally connected to said end cap of said vertical support column, whereby said channel shaped legs lie in a parallel circumferential relationship embracing said lower section of said vertical support column when said base coupling is in the stored position and said legs form a tripod structure when said base coupling is in the deployed position.

2. The stand according to claim 1 wherein said lower section of the vertical support column and said legs have approximately equal lengths.

3. The stand according to claim 1 wherein said struts each have a length approximately equal to a distance separating the first end of said legs from the intermediate point of said legs.

4. The stand according claim 1 wherein the intermediate point is located at a midpoint between the first end and the second end of said legs.

5. The stand according to claim 1 further comprising a support having a planer member with a lip along a lower side and projecting forwardly, a rear side of the support having means for detachable engagement with the connector.

* * * * *